United States Patent [19]

Rinker

[11] 4,168,717

[45] Sep. 25, 1979

[54] TEMPERATURE ACTUATED SIPHON SYSTEM

[75] Inventor: William R. Rinker, Cuyahoga Falls, Ohio

[73] Assignee: The B. F. Goodrich Company, Akron, Ohio

[21] Appl. No.: 880,664

[22] Filed: Feb. 23, 1978

[51] Int. Cl.[2] ..... F04F 10/00

[52] U.S. Cl. ..... 137/135; 137/140; 137/142; 137/151

[58] Field of Search ..... 137/135, 140, 142, 147, 137/148, 150, 151

[56] References Cited

U.S. PATENT DOCUMENTS

| | | | |
|---|---|---|---|
| 301,391 | 7/1884 | Reinecke | 137/142 X |
| 2,313,855 | 3/1943 | Wiggins | 137/147 X |
| 4,059,126 | 11/1977 | Nickerson | 137/142 |

*Primary Examiner*—Gerald A. Michalsky
*Attorney, Agent, or Firm*—James R. Lindsay

[57] ABSTRACT

A siphon system in which an enclosed container has a chamber for heating a gaseous fluid as by solar radiation. The chamber is in continuous open communication with a siphon having an inlet at an upper level and an outlet at a lower level. A pressure responsive valve is located at the outlet for permitting the release of gaseous fluid at pressures over atmosphere and closing the outlet to communicate pressures below atmosphere to the inlet to start the siphon. When the siphon is filled, the pressure responsive valve opens to release the liquid from the outlet. A float valve may be used at the inlet to retain a below atmospheric pressure in the system for immediate operation when the liquid accumulates at the inlet.

8 Claims, 3 Drawing Figures

TEMPERATURE ACTUATED SIPHON SYSTEM

BACKGROUND OF THE INVENTION

This invention relates generally to drains and apparatus for priming a siphon and particularly to a temperature actuated apparatus which utilizes solar energy to fill the siphon. An apparatus of this general type is shown and described in U.S. patent application Ser. No. 714,867 now U.S. Pat. No. 4,059,126, of Malcolm Horace Nickerson which is assigned to the assignee of this application. The container having the heating and cooling chamber of the prior application has one valve for exhausting air at above atmospheric pressure from the chamber during heating of the air in the chamber and a check valve in communication with the siphon for containing above atmospheric pressure in the chamber. These valves are in addition to the valve at the outlet of the siphon. During operation the amount of subatmospheric pressure in the chamber increases as a result of temperature changes and exposure to the sun which makes it necessary to construct the container surrounding the chamber with sufficient strength to withstand the forces resulting from the increased subatmospheric pressure and thereby prevent collapse of the container.

SUMMARY OF THE PRESENT INVENTION

The present invention provides an apparatus in which no valves are required in the container and the chamber is in continuous direct communication with the inlet of the siphon. The apparatus need have only one valve at the outlet unless an additional float valve is desired at the inlet end. Also the container may be of a relatively light construction because the air may be vented in and out of the inlet of the siphon when no water is at the inlet for removal. Accordingly the preferred embodiment of the present invention provides an automatic self-actuated drainage system for removing standing water from a roof of a building with only one valve at the siphon outlet. The connection between the vacuum line to the chamber and the siphon line between the inlet and outlet is located at a position below the inlet to provide reliability of operation. The weight of the water in the siphon line opens the valve at the outlet and the siphon will continue to operate until the inlet is no longer immersed in the water.

DESCRIPTION OF THE DRAWINGS

The further objects and advantages of this invention will become apparent from the following description and the accompanying drawings wherein.

DETAILED DESCRIPTION OF THE PREFERRED EMBODIMENT

As set forth above, the present invention relates to a temperature actuated siphon system which uses changes in temperature such as that caused by solar energy for priming a siphon and has particular application to the draining of standing water from a flat roof. There is illustrated hereinafter the manner in which the present invention is employed for siphoning water from a roof. However from the description which follows, the manner in which this invention may be applied to numerous types of systems will become readily apparent to those of ordinary skill in the art.

Figure 1:
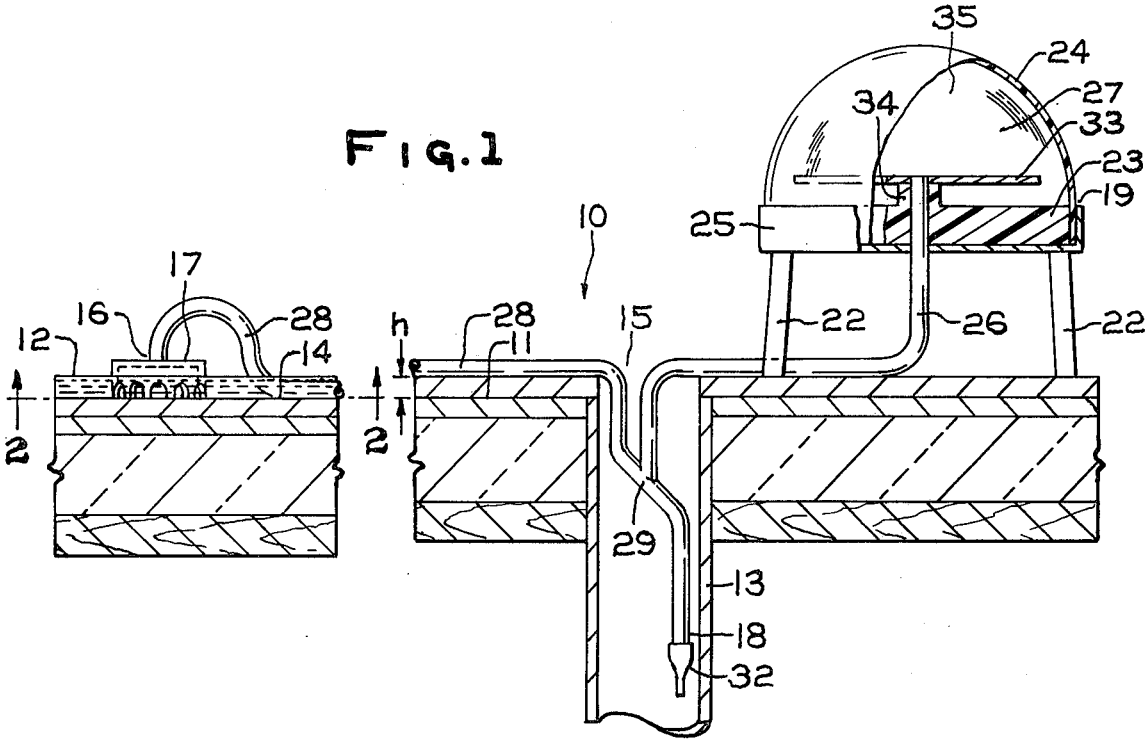
FIG. 1 is a fragmentary sectional view of the apparatus embodying the invention installed on the roof of an industrial building with parts being broken away.
Figure 2:
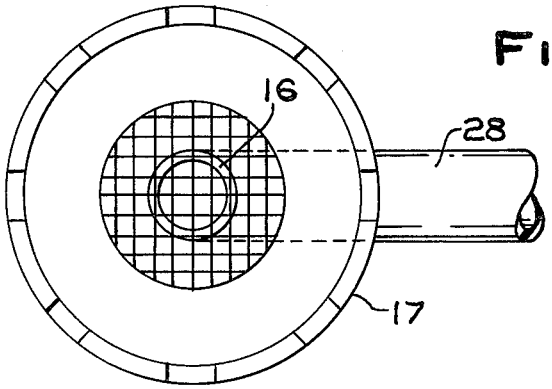
FIG. 2 is a bottom view of the inlet and strainer taken along the plane of line 2—2 of FIG. 1.

Referring now to FIGS. 1 and 2, there is shown a temperature actuated siphon system 10 installed on a flat roof 11 of the type on which a pond 12 of standing water occurs due to lack of proper drainage of the roof after a rain or due to daming of the standing water by melting ice and snow. A roof drain pipe 13 extends through the roof 11 at a position spaced from the pond 12 of standing water. The roof surface 14 at the pond 12 of standing water may be lower than the roof surface at the drain pipe 13 by an amount (h) causing the pond of standing water to form on the roof.

In accordance with this invention, a siphon 15 has an inlet 16 which may include a cup-shaped strainer 17. The siphon 15 also has an outlet 18 positioned in the roof drain pipe 13. The inlet 16 is at an upper level and the outlet 18 is at a lower level below the inlet.

A container 19 mounted on legs 22 rests on the roof surface 14 above or adjacent to the roof drain pipe 13. As shown in FIG. 1, container 19 has a fixed volume and may include a circular plate 23 and a transparent dome 24 of hard, high-impact plastic material held together in a metal case 25 or other suitable retainer. The respective peripheral edges of the plate 23 and the transparent dome 24 are in substantially airtight sealing relationship with each other. If desired, the transparent dome 24 may be bonded directly to the circular plate 23 eliminating the metal case 25. A suitable bonding agent may be used to insure an airtight seal along the peripheral edges of the plate 23 joining the plate to the transparent dome 24.

The siphon 15 has a first tubular member 26 extending from a chamber 27 within the container 19 through the circular plate 23 and metal case 25 to the outlet 18. A second tubular member 28 extends from the inlet 16 to a connection 29 with the first tubular member 26. Preferably the connection 29 is at a position below the inlet 16.

A one-way pressure responsive valve such as flutter valve 32 is mounted on the outlet 18 of the first tubular member 26. The flutter valve 32 is normally closed and is responsive to open when the pressure within the siphon 15 exceeds atmospheric pressure or when the siphon is filled with liquid such as water.

In its preferred embodiment, the dome 24 permits infrared radiation from the sun to easily pass into the chamber 27 within the container 19. A black body, preferably in the form of a thin gauge blackened aluminum disc 33, is mounted on a central support 34 projecting upwardly and away from the plate 23 as shown in FIG. 1. The disc 33 serves to absorb radiant energy from the sun and to transfer the radiant energy to a gaseous fluid medium such as air 35 within the chamber 27.

In operation of the siphon system 10, the inlet 16 is positioned on the flat roof 11 in an area where a pond 12 of standing water will form so that after a rain the strainer 17 and inlet 16 will be immersed in the water.

When the container 19 is exposed to the sun, the radiant energy from the sun will heat and expand the gaseous fluid or air 35 within the chamber 27 by the increase in temperature augmented by the disc 33 which absorbs radiant energy from the sun and transfers this energy to the air within the chamber. As the air 35 expands within the chamber 27, the pressure increases and this pressure is communicated through the tubular member 26 to the siphon 15 causing a portion of the air to be exhausted through the inlet 16 or flutter valve 32 at the outlet 18.

After this portion of the air 35 has been ejected, the pressure within the chamber 27 will be reduced and the flutter valve 32 will be closed preventing further communication of air between the atmosphere outside the chamber and the chamber itself. Then during the cool evening hours or during periods of cloud coverage of the sun, the remaining portion of the air 35 within the chamber 27 will be cooled and will contract. The resulting subatmospheric pressure within the chamber 27 is communicated through the tubular member 26 and tubular member 28 to the inlet 16 causing the water in the pond 12 to be drawn into the second tubular member 28 towards the connection 29 below the inlet and through the tubular member 26 to the outlet 18. The head of water in the tubular member 26 will then open the flutter valve 32 and the water in the pond 12 will be siphoned into the drain pipe 13. As shown in FIG. 1, the chamber 27 is in continuous open communication with the siphon 15 and the only communication with the siphon is through the first tubular member 26.

When the water in the pond 12 has been siphoned into the drain pipe 13, the flutter valve 32 will close and the siphon system will then be ready for automatic operation when water is again accumulated in the pond. In the meantime, when the inlet 16 is opened to the air and there is no water in the pond 12, the changes in temperature causing heating of the air 35 within the chamber 27 will not increase the pressure in the container 19 since the air will be vented out of the inlet during heating and will be able to enter the siphon 15 through the inlet during the cooling of the chamber 27. This breathing is advantageous because it permits a construction of container 19 so that it need not withstand the higher pressures which may develop upon continuous heating and cooling of the air 35 in the chamber 27.

Figure 3:
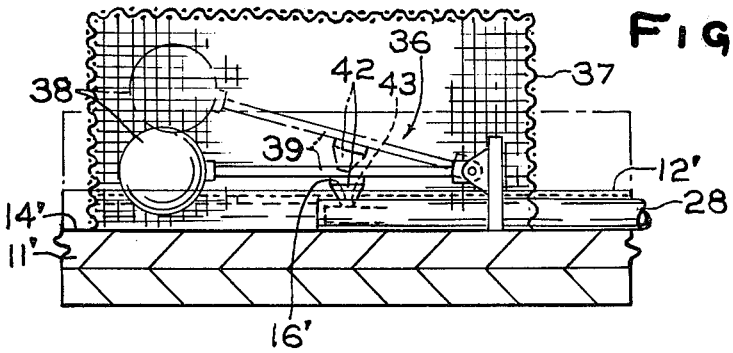
FIG. 3 is a fragmentary elevation like FIG. 1 of a modified form of inlet with a float valve showing the float in the raised open position in phantom lines.

Referring to FIG. 3, a modification is shown in which a float valve responsive to liquid level is mounted on the inlet 16' of the tubular member 28' within a screened enclosure or strainer 37 on the roof surface 14' of the flat roof 11'. The pond 12' of standing water accumulates on the roof surface 14' and floats a ball 38 of the float valve 36 which may be carried on the end of a lever 39 mounted on a pivot and moving a valve cover 42 into and out of a valve seat 43 for closing and opening the inlet 16'.

In operation of this modification, the float valve 36 is normally closed when there is no standing water in the pond 12' and accordingly the heating of the air 35 in the chamber 27 will cause a portion of the air to be ejected through the flutter valve 32 resulting in a subatmospheric pressure within the siphon 15. When there is rain or some other cause resulting in an accumulation of standing water in the pond 12', the float 38 will be raised to a position shown in phantom lines in FIG. 3 and the valve cover 42 will be lifted off the valve seat 43. The subatmospheric pressure which had been developed within the siphon 15 then immediately functions to transfer the water from the pond 12' into the tubular member 28' and to the tubular member 26 where the head of water opens the outlet flutter valve 32 to actuate the siphon and drain the water from the pond. After the water has been drained and the water level drops, the ball 38 will drop to the position shown in full lines and close the valve seat 43 with valve cover 42 whereupon the heating and cooling of the air in the chamber 27 can again build up the subatmospheric pressure in the siphon 15 for immediate action when the water accumulates in the pond 12'.

With this construction, the operation of the preferred embodiment and modification has a high degree of reliability because the connection 29 is located below the inlet 16 and the water is transferred into the outlet leg of the tubular member 26 with a very high probability that the water will not be pulled into the chamber 27.

With the foregoing disclosure in mind, many and varied obvious modifications of this invention will become readily apparent to those of ordinary skill in the art.

Therefore, what is claimed is:

1. A temperature actuated siphon system for transferring liquid from an upper level to a lower level, said siphon system having a siphon with an inlet for immersion in said liquid at said upper level and an outlet at said lower level, an enclosed container of hard material having a chamber of fixed volume in continuous open communication with said siphon, valve means at said outlet being responsive to open when the fluid pressure in said siphon exceeds atmospheric pressure and to close at lower pressures, means associated with said chamber for absorbing heat and thereby increase the pressure of gaseous fluid within said chamber and siphon, said system providing for ejection of a portion of said gaseous fluid under increased pressure from said chamber and siphon through said inlet or valve means, and a reduction in pressure of the remaining portion of gaseous fluid within said chamber on cooling for communication to said inlet causing said liquid from said upper level to flow into said siphon and towards said outlet, said valve means opening upon filling of said siphon with said liquid whereby said liquid is transferred from said upper level to said lower level.

2. A temperature actuated siphon system according to claim 1 wherein said valve means is a flutter valve.

3. A temperature actuated siphon system according to claim 1 wherein the only communication with said chamber is to said siphon.

4. A temperature actuated siphon system according to claim 1 wherein said siphon includes a first tubular member extending from said chamber to said outlet and a second tubular member extending from said inlet to a connection with said first tubular member between said chamber and said outlet.

5. A temperature actuated siphon system according to claim 4 wherein said connection between said first tubular member and said second tubular member is at a position below said inlet.

6. A temperature actuated siphon system according to claim 1 wherein said inlet includes a normally closed second valve means in addition to said first-mentioned valve means, said second valve means being responsive to open when the liquid level at said inlet rises above a predetermined level for maintaining a reduced pressure in said system prior to the time when the siphon is needed and then opening the inlet when the siphon is needed to remove liquid from the area of said inlet.

7. A temperature actuated siphon system according to claim 6 wherein said siphon includes a first tubular member extending from said chamber to said outlet and a second tubular member extending from said inlet to a connection with said first tubular member at a position below said inlet so that when the liquid is transferred to said connection said siphon is operative.

8. A temperature actuated siphon system according to claim 6 wherein said second valve means is a float valve.

* * * * *